US012050088B2

(12) United States Patent
Brulin et al.

(10) Patent No.: US 12,050,088 B2
(45) Date of Patent: Jul. 30, 2024

(54) PROFILED SCREENING ELEMENT

(71) Applicant: SAINT-GOBAIN CENTRE DE RECHERCHES ET D'ETUDES EUROPEEN, Courbevoie (FR)

(72) Inventors: Jérôme Brulin, Saint-Martin-de-Crau (FR); Matthieu Graveleau, Avignon (FR); Alexane Margossian, Pernes-les-Fontaines (FR)

(73) Assignee: SAINT-GOBAIN CENTRE DE RECHERCHES ET D'ETUDES EUROPEEN, Courbevoie (FR)

( * ) Notice: Subject to any disclaimer, the term of this patent is extended or adjusted under 35 U.S.C. 154(b) by 0 days.

(21) Appl. No.: 18/012,895

(22) PCT Filed: Jul. 2, 2021

(86) PCT No.: PCT/FR2021/051214

§ 371 (c)(1),
(2) Date: Dec. 23, 2022

(87) PCT Pub. No.: WO2022/003300

PCT Pub. Date: Jan. 6, 2022

(65) Prior Publication Data

US 2023/0258434 A1 Aug. 17, 2023

(30) Foreign Application Priority Data

Jul. 2, 2020 (FR) ..... 2006993

(51) Int. Cl.
*F41H 5/04* (2006.01)

(52) U.S. Cl.
CPC ..... *F41H 5/0414* (2013.01); *F41H 5/0442* (2013.01)

(58) Field of Classification Search
CPC ..... F41H 5/023; F41H 5/02; F41H 5/0442; F41H 5/0414
See application file for complete search history.

(56) References Cited

U.S. PATENT DOCUMENTS 619,295 A * 2/1899 Flodquist ..... F41H 5/02 114/11
3,395,067 A * 7/1968 Lane, Jr. ..... F41H 5/0435 428/164

(Continued)

FOREIGN PATENT DOCUMENTS

EP 1 380 809 A2 1/2004
EP 2 095 055 A1 9/2009

(Continued)

OTHER PUBLICATIONS

International Search Report as issued in International Patent Application No. PCT/FR2021/051214, dated Oct. 8, 2021.

(Continued)

*Primary Examiner* — Joshua E Freeman
(74) *Attorney, Agent, or Firm* — Pillsbury Winthrop Shaw Pittman LLP

(57) ABSTRACT

A screening element in the form of a sintered monolithic body has an outer face and an opposing inner face with an area of the faces greater than 100 $cm^2$ and the mean thickness $E_m$ between the faces greater than 4 mm. At least a portion of the outer face is textured such that Ai decreases from the inner face from a value of i greater than at least 50, $A_{75} \geq 0.2 \times A_0$ and $A_{95} < 0.9 \times A_0$, $0.03 \times A_0 < A_{95} < 0.5 \times A_0$ and $A_{100} < 0.1 \times A_0$. Ai being the area occupied by the material alone along a plane i of internal section at the intermediate thickness $E_i$ and i corresponding in percentage to the fraction of the mean thickness $E_m$ at plane i.

20 Claims, 7 Drawing Sheets

(56) References Cited

U.S. PATENT DOCUMENTS

| | | | | |
|---|---|---|---|---|
| 3,636,895 | A * | 1/1972 | Kelsey | F41H 5/02 109/78 |
| 6,200,664 | B1 * | 3/2001 | Figge | F42B 39/16 428/920 |
| 6,389,594 | B1 | 5/2002 | Yavin | |
| 8,434,396 | B1 * | 5/2013 | Wiley | F41H 5/013 89/36.01 |
| 8,468,926 | B2 * | 6/2013 | Treadway | F41H 5/023 89/36.02 |
| 8,646,373 | B1 * | 2/2014 | Kucherov | F41H 5/02 89/938 |
| 9,207,048 | B1 * | 12/2015 | Roland | F41H 5/0492 |
| 9,944,041 | B1 * | 4/2018 | Iliev | B32B 5/26 |
| 10,274,289 | B1 * | 4/2019 | Barnhart, II | F41H 1/02 |
| 11,243,051 | B2 * | 2/2022 | Roux | F41H 5/04 |
| 11,473,877 | B2 * | 10/2022 | Speyer | B32B 5/26 |
| 2005/0235818 | A1 * | 10/2005 | Lucuta | F41H 5/0428 89/36.02 |
| 2006/0201318 | A1 * | 9/2006 | LaBrash | F41H 5/023 89/36.02 |
| 2009/0252982 | A1 * | 10/2009 | O'Keefe | G02B 5/045 428/68 |
| 2010/0212484 | A1 * | 8/2010 | Williams | F41H 5/0421 89/902 |
| 2011/0303079 | A1 * | 12/2011 | Joynt | F41H 5/023 89/917 |
| 2015/0253114 | A1 * | 9/2015 | Neal | F41H 5/0457 89/36.02 |
| 2016/0161222 | A1 * | 6/2016 | Lee | A42B 3/064 2/416 |
| 2019/0323801 | A1 * | 10/2019 | Bright | E04C 2/26 |
| 2020/0033097 | A1 * | 1/2020 | Speyer | B32B 3/04 |

FOREIGN PATENT DOCUMENTS

| | | | |
|---|---|---|---|
| JP | 2005-247622 | A | 9/2005 |
| WO | WO 2008/130451 | A1 | 10/2008 |

OTHER PUBLICATIONS

Karandikar, P., et al., "Effects of novel geometric designs on the ballistic performance of ceramics," Advances in Ceramic Armor X, Dec. 2014, pp. 12-22.

* cited by examiner

[FIG. 1]
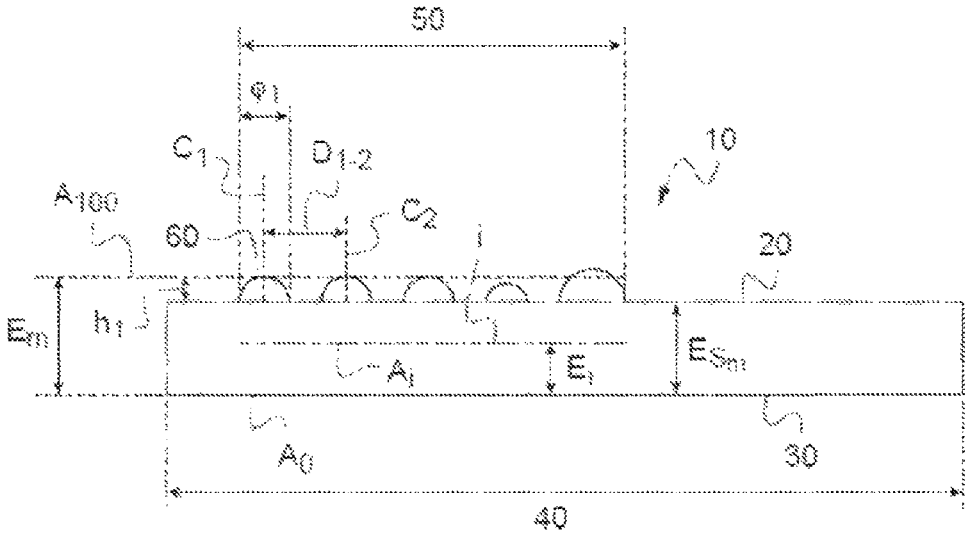
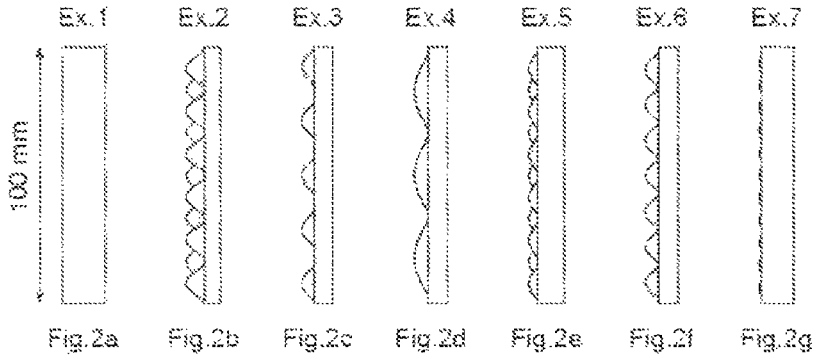
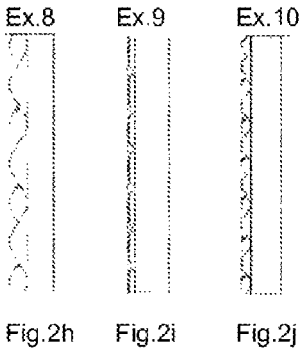

[FIG. 3]
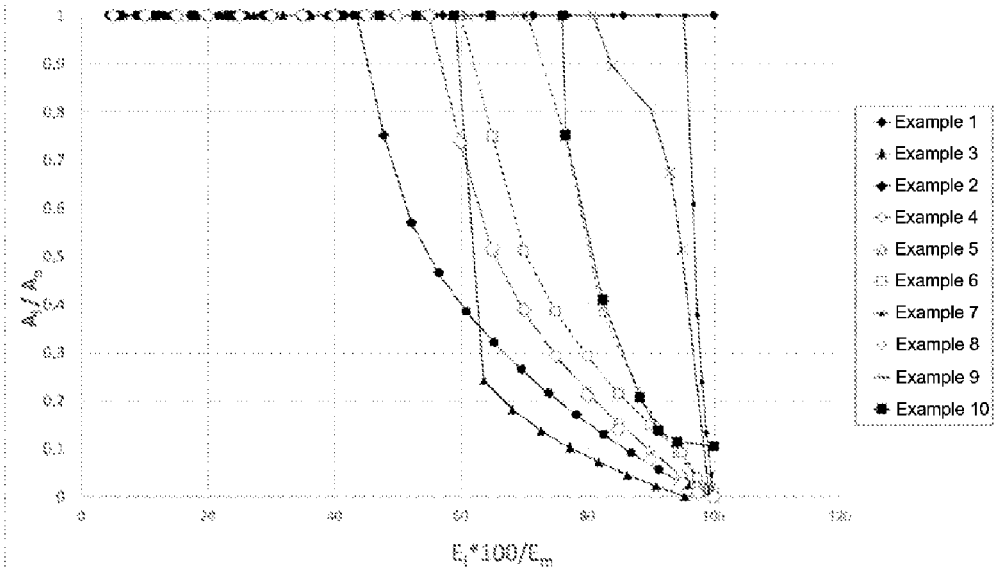
[FIG. 4]
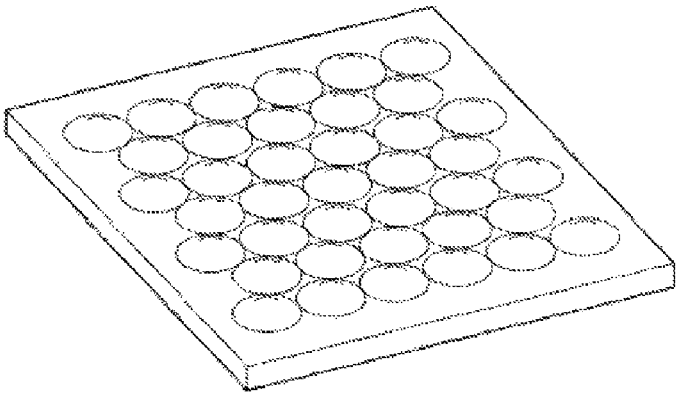

[FIG. 5]
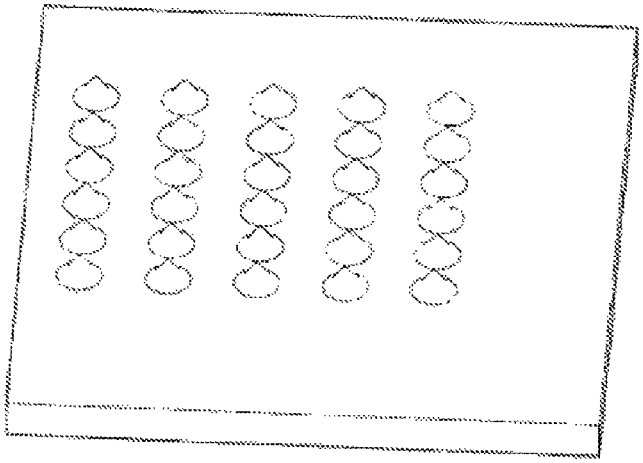
[FIG. 6]
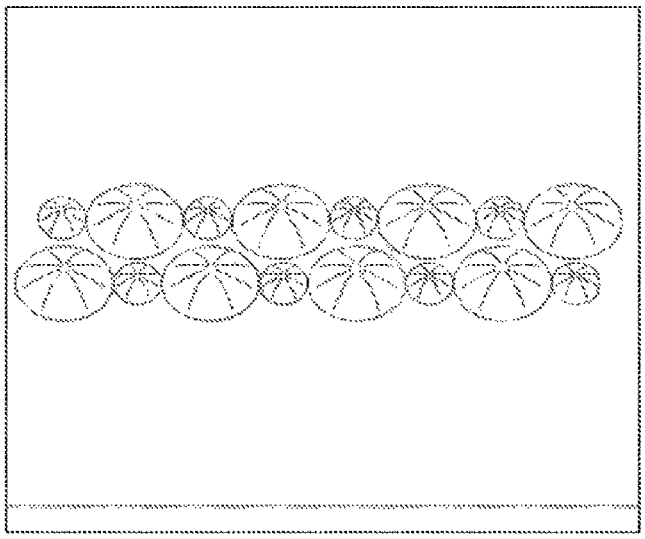

[FIG. 7]
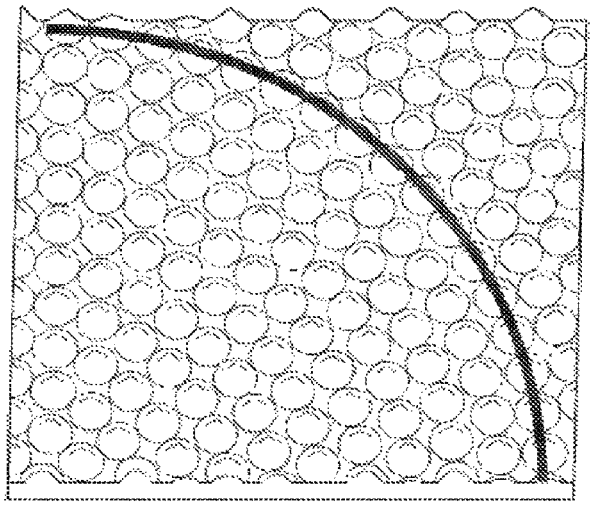
[FIG. 8]
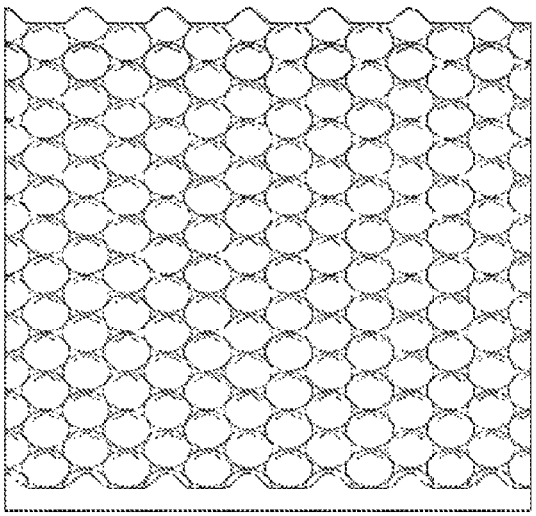

[FIG. 9]
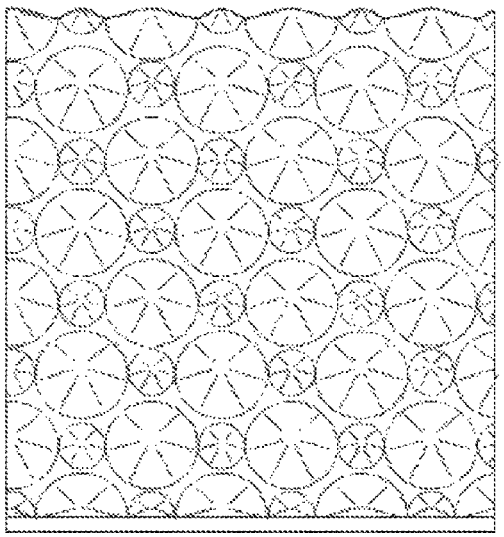
[FIG. 10]
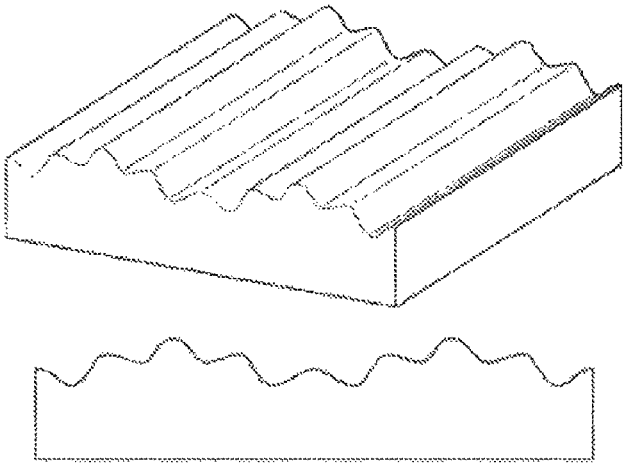

[FIG. 11]
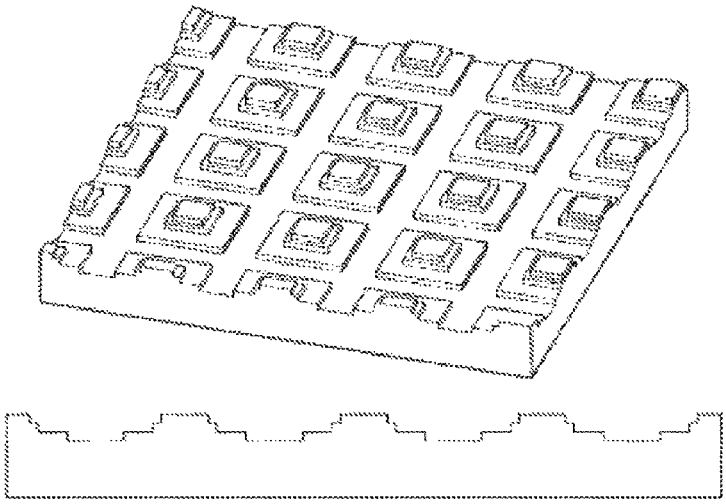
[FIG. 12]
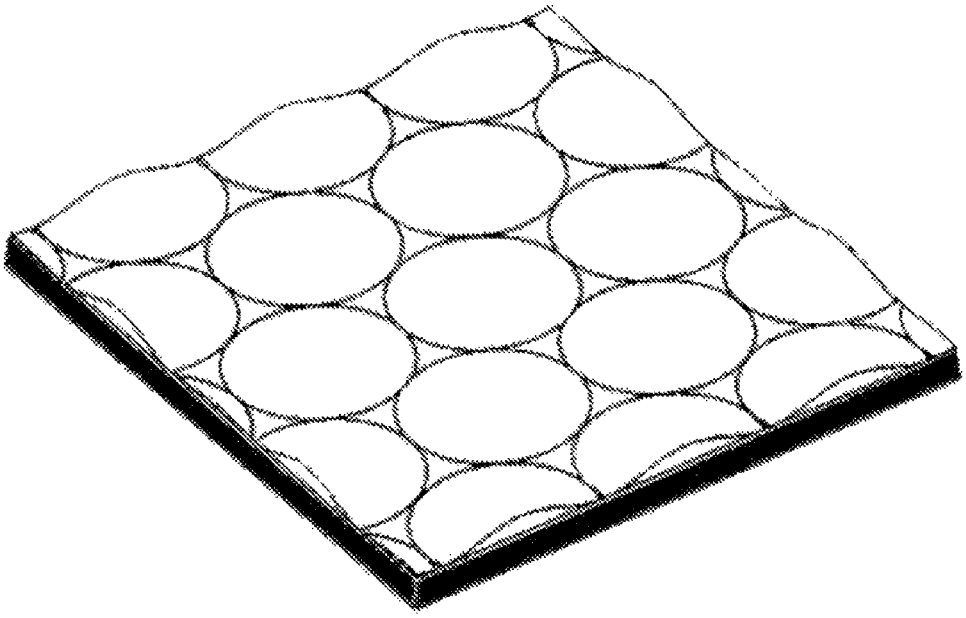

[FIG. 13]
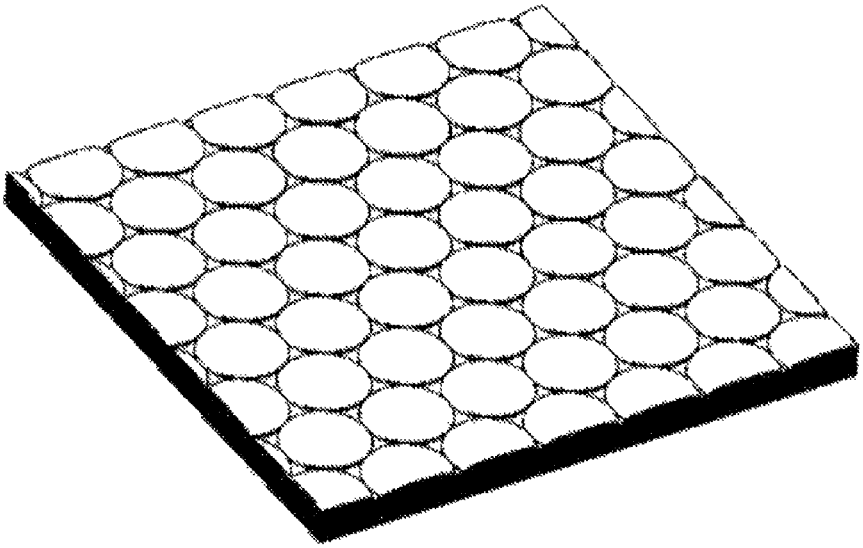
[FIG. 14]
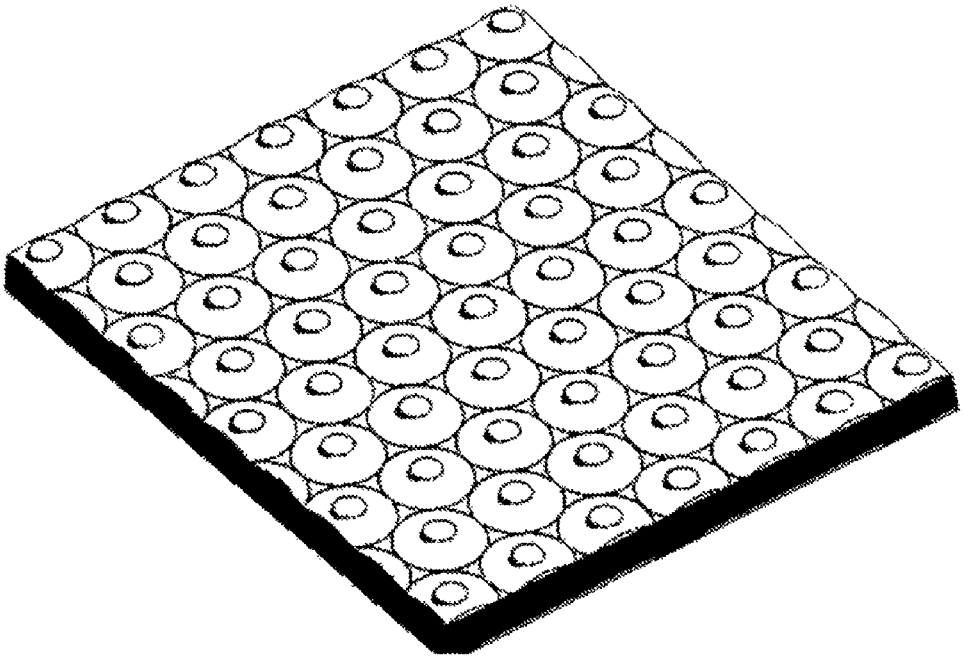

PROFILED SCREENING ELEMENT

CROSS-REFERENCE TO RELATED APPLICATIONS

This application is the U.S. National Stage of PCT/FR2021/051214, filed Jul. 2, 2021, which in turn claims priority to French patent application number 2006993 filed Jul. 2, 2020. The content of these applications are incorporated herein by reference in their entireties.

TECHNICAL FIELD

The invention relates to a screening element, in particular for antiballistic protection, the impact surface of which has a shape particularly suited to this function, a protection system comprising such an element and the method for manufacturing such an element.

The invention finds its application in particular as armor used for bullet-proof vests or other screening to protect vehicles (land, sea or air) or stationary installations (building, perimeter wall, guard post in particular).

PRIOR ART

In particular, the additional mass associated with the wearing of an antiballistic protection element such as armor or screening is an essential criterion whether it concerns the protection of persons but also with respect to vehicles. Notably, it is a question of avoiding excessive load, which is an obstacle to rapid movement and limits their range of action.

In particular, systems are known that are formed by the so-called "mosaic" assembly of ceramic pieces having a specific polygonal shape and individually resistant to the impact of a projectile. JP2005247622 describes, for example, an arrangement of such shapes from 20 to 100 mm wide, for a thickness of a few mm. This type of mosaic of parts has the benefit of resisting successive shots (so-called "multi-shot" or "multi-hit" protection). The assembly of such "mosaic" structures is, however, long and expensive. In addition, it can be difficult to keep the overall tolerance of the assembly low because the tolerances of each part add up to constitute the assembly. This has an impact on the width of the residual spaces between the parts (joint planes) produced by the assembly. Moreover, if it additionally has a curved shape, the spaces constitute an important area of weakness of this protection system when the projectile impacts these places.

US2015/0253114A1 discloses such a so-called composite screening element formed by an assembly of ceramic disks or tiles, the profile of the impact face of which comprises pointed protrusions, for example, cones or pyramids (see FIGS. 17A to 26C). This particular profile called Dragon Skin® by the applicant would in particular improve the multi-impact resistance and avoid the risk of ricochet during ballistic impact.

There are other so-called monolithic systems, i.e. formed by a single piece or even by a very limited number of pieces with large surface areas, each monolith having an impact surface area greater than 100 $cm^2$, or even 150 $cm^2$, in order to reduce the number of joints.

Numerous materials have been proposed, in particular to constitute an armor intended for people for which the ratio of mass of screening to protective surface area (or surface density) must remain low, typically less than 50 $kg/m^2$, or a non-personal screening intended for vehicles or stationary installations for which the ratio of mass to protective surface area is typically higher than 10 $kg/m^2$.

Metals and alumina are commonly used as screening, but they have a high surface density to achieve the desired protection.

More recently, products based on non-oxide ceramics have been proposed, with a lower ratio of mass to screening surface area or surface density for the equivalent impact resistance.

Beyond the general form called mosaic or monolithic, different configurations have been proposed. For example, the publication EP 1380809 A2 discloses a system comprising two layers of material, the first denser layer A formed on the surface by a carbide and a metal, for example silicon carbide SiC and silicon metal Si, and a second more porous layer B formed by the carbide, for example silicon carbide.

U.S. Pat. No. 6,389,594B1 proposes an outershell of monolithic ceramic armor that is placed under compressive stress. This shell is made of a polymeric material based on aramid or other antiballistic materials, especially based on glass fibers. This outershell does not prevent the fracturing of the monolithic block and if the latter has a size higher than 100 $cm^2$ and/or if the projectile is of high-caliber, because of the important energy to dissipate, the effect of "blocking" is too weak, the decohesion of the monolithic block is strong and the resistance to multiple shots remains too weak.

More recently, WO2008/130451 (EP2095055A1) proposed an approach consisting of reducing the propagation of the stress wave related to the impact of the projectile by using a shell formed this time by a permeable medium, typically a layer of organic fibers (e.g. aramid) fixed on the ceramic part and then impregnated by a hyperelastic polymer in order to absorb the energy related to the impact of the projectile and to reduce the propagation of cracks and the multifracturing of the ceramic material. This system is only of interest for ceramic parts also small in size and the tested example is made from an assembly of 9 ceramic parts of size 100 mm*100 mm*8 mm. The energy absorbed by this new shell cannot prevent the decohesion of a ceramic block with a surface area greater than 150 $cm^2$.

The publication "effects of novel geometric designs on the ballistic performance ceramics" by P. Karandikar et al in Advances in Ceramic Armor X discloses different geometries of ceramic or metal screening plates including some for which the impact surface has holes, recesses or bumps. The authors do not observe any improvement, or even a deterioration in performance when this texturing is applied on the impact face. However, no information is provided in this publication on the exact dimensions and distribution of the texturing applied.

There is, therefore, a continuous need for improvement of the products used as screening, this improvement being measured in particular by their ballistic performance, for a comparable surface density.

The object of the present invention is therefore to propose a new product, different from the products currently used in the field, and whose ballistic performance is improved, at equal surface density.

In particular, there is currently a need for a monolithic screening with a surface area greater than 100 $cm^2$, preferably greater than 150 $cm^2$, even more preferably greater than 200 $cm^2$, or even greater than 500 $cm^2$ or even greater than 1,000 $cm^2$, capable of withstanding shots from piercing projectiles with a diameter greater than or equal to 5.56 mm in the same region of the screening, but which nevertheless has a low apparent density, typically less than 8.5 $g/cm^3$, or even less than 5 $g/cm^3$, in order to protect the wearer of the protection without weighing them down, or the vehicles (land, sea or even airborne) or the stationary installations such as buildings, equipped with such protection.

DISCLOSURE OF THE INVENTION

According to a first general aspect, the present invention relates to a screening element in the form of a monolithic body, for example a plate, a tube or a more complex shape such as a helmet, having an upper surface (or impact surface), in particular of straight or curved shape, comprising grains of a material characterized as hard. Said body may be provided on its inner face (or opposite the impact face) with an energy-dissipating back coating, preferably made of a material of lower hardness than that of the material constituting the body of the protective element.

More precisely, the present invention relates to a screening element, in the form of a monolithic body having an outer face or impact face and an inner face, opposite to said impact face, said inner and outer faces being preferably substantially parallel, preferably parallel to each other, wherein:

said body is made of a sintered material, the surfaces of said inner and outer faces are greater than or equal to 100 $cm^2$ said body being characterized in that at least a portion of said impact face of said body is textured, such that, the mean thickness $E_m$ between said outer and inner faces of said body on said portion is greater than 4 mm, on this portion and along a plane i of internal section of said body parallel to said inner face, with $0<i<100$ and i corresponding in percentage to the fraction of said mean thickness $E_m$ at plane i, starting from the inner face and in the direction of the impact face, Ai being the area occupied by the material alone at thickness $E_i$, at the level of an intermediate surface located between the surface of the inner face of area $A_0$ and the outer surface of area $A_{100}$ corresponding to the area of material at the mean thickness $E_m$, the surface of an intermediate area $A_i$ is less than said area $A_0$ from a value of i greater than at least 50, ($A_i<A_0$ if $i\geq 50$) and preferably less than or equal to 80 ($A_i<A_0$ if $i<80$).

the thickness $E_i$ from which the area Ai decreases, also called $E_{sm}$, is greater than 50%, preferably greater than 55% and/or less than 95%, preferably less than 90%, even more preferably less than 80% or even less than 75%, or even less than 70% of the mean thickness of said body.

$A_i$ decreases continuously or discontinuously (e.g. in increments) according to i, when $A_i<A_0$ (or when $E_i>E_{50}$)

$A_{75}\geq 0.2\times A_0$, $0.03\times A_0<A_{95}<0.5\times A_0$, preferably $0.04\times A_0<A_{95}<0.2\times A_0$.

$A_{100}<0.1\times A_0$.

"Continuous" means $A_{i+\varepsilon}<A_i$, regardless of $i\geq 50$.

"Discontinuous" means that the relationship $A_{i+\varepsilon}<A_i$ is not verified over the entire range of the domain $100\geq i\geq 50$.

For the purposes of the present invention, the sectional plane i considered is not necessarily flat. In particular, if said inner face is curved, said sectional plane i is of course also curved. In such a configuration, it is understood that the term "sectional plane" is to be understood as the sectional surface parallel to said inner face at the point considered.

As will be discussed later, the area of the intermediate surface of material along said parallel internal sectional plane can be easily measured by a cross-section of said body and preferably by non-destructive methods such as tomography and the use of computer-aided drawing software, for example.

It is understood that the area $A_i$ occupied by the material alone also includes its possible porosity.

The advantage of the present invention lies in an optimal choice of the element's profile, making it possible to increase the initial contact surface with the projectile, without a substantial increase in material. Such an embodiment makes it possible to deflect the projectiles and to reduce their perforating power taking into account the thickness of the non-textured part of the screening element necessary to absorb a part of the energy due to the impact in order to consequently limit its fragmentation.

Preferably, $A_{75}<0.9\times A_0$. Preferably, $A_{75}<0.6\times A_0$. More preferably $A_0<0.4\times A_0$.

$A_{80}<0.8\times A_0$. Preferably, $A_{80}<0.6\times A_0$. More preferably $A_{80}<0.5\times A_0$. Preferably $A_{80}>0.15\times A_0$. More preferably $A_{80}>0.2\times A_0$.

$A_{85}<0.8\times A_0$. Preferably, $A_{85}<0.6\times A_0$. More preferably $A_{85}<0.5\times A_0$. More preferably $A_{85>0.15}\times A_0$.

$A_{90}<0.5\times A_0$. Preferably, $A_{90}<0.4\times A_0$. More preferably $A_{90}<0.3\times A_0$ and even $A_{90}<0.2\times A_0$. Preferably $A_{90}>0.05\times A_0$. More preferably $A_0>0.1\times A_0$.

The area $A_{95}$ corresponding to the intermediate surface of material measured along an internal sectional plane of said body parallel to the inner face at 95% of the mean thickness of said body starting from the inner face in the direction of the impact face is greater than 3%, preferably greater than 4%, and/or less than 30%, preferably less than 20%, more preferably less than 15%, or even less than 10% of the area of the inner face or $A_0$.

The area $A_{100}$ corresponding to the material surface on the upper face (or impact face) of said body according to a sectional plane at the level of its mean thickness is less than or equal to 20% of $A_0$, preferably less than 10% of $A_0$, preferably less than 7%, preferably less than 5% of $A_0$. Preferably still $A_{100}$ tends to 0.

From a value of i greater than at least 50, the relative variation $(A_{i+2}-A_i)\times 100/A_i$ is less than 30%.

From a value of i greater than at least 75, the relative variation $(A_{i+2}-A_i)\times 100/A_i$ is less than 20%.

$E_i$ from which the area $A_i$ decreases, also called $E_{sm}$, is greater than 4 mm.

The surface area of the inner face is greater than 150 $cm^2$, greater than 200 $cm^2$, greater than 250 $cm^2$, preferably greater than 400 $cm^2$, preferably greater than 500 $cm^2$, and even more preferably greater than 1,000 $cm^2$, The width or diameter of the inner face is greater than 20 cm.

Said body has a mean thickness $E_m$ greater than 7 mm, preferably greater than 10 mm, preferably greater than 15 mm, preferably greater than 20 mm, Even more preferably, in particular:

Said body according to the invention, on at least a portion of its impact face, has a plurality of designs corresponding to a local variation of the thickness of said body. This local variation in thickness may follow a function or profile whose curve in a plane perpendicular to the sectional plane may have one or more changes in curvature.

Said designs may have the following characteristics:

The designs are preferably protrusions or protuberances, in the form of cones, pyramids with a polygonal base, or even designs with a sinusoidal profile.

The width or the diameter ϕ of the designs of said portion is between 1 and 5 times the thickness $E_m$, preferably between 1.5 and 4 times the thickness $E_m$.

The width or the diameter ϕ of the designs of said portion is greater than or equal to 3 mm and/or less than or equal to 40 mm.

The height h of the designs is less than 0.5 times the thickness $E_m$, preferably h is between 0.05 and 0.5 times the thickness $E_m$.

The height of the designs of said portion is greater than or equal to 0.5 mm and/or less than or equal to 5 mm.

The spacing D between two adjacent designs corresponding to the greatest distance measured between their respective centers is less than 5 times the thickness $E_m$, preferably less than 4 times the thickness $E_m$, more preferably less than 3.5 times the thickness $E_m$.

The spacing D between two adjacent designs corresponding to the largest distance measured between the respective centers of two designs is less than or equal to 40 mm. Preferably, the spacing D is adapted to the caliber of the projectile against which the armor is intended. In particular, the spacing D is preferably equal to twice the caliber of the projectile plus or minus 30%. For example, for a 7.62 mm caliber, D is equal to 15.2+/−4.6 mm. According to one possible mode, the designs are contiguous, i.e. their spacing is substantially equal to their width or diameter.

The number of designs per 100 $cm^2$ of said impact (exterior) surface is greater than 10, preferably greater than 20.

The design extends by translation along one or preferably two different directions, these two directions being preferably perpendicular to each other.

In one particular mode, a design may be more complex and composed of superimposed sub-designs to deflect projectiles of different calibers, each sub-design being adapted to a particular threat. FIG. 10 or FIG. 11 illustrates an example of such an embodiment. According to one possible mode, the sub-designs respond to the same basic shape according to a different scale, for example in a homothetic way or a fractal structure.

According to another possible mode, the general shape of the design is sinusoidal and/or comprises sub-designs in the form of harmonics, especially of different amplitudes or pitches.

According to one particular mode, the distribution of the designs on the impact surface is regular, i.e. designs of the same morphology (height and width) are spaced at the same distance.

According to one possible mode, said body has a flat inner face.

According to another possible mode, the inner face and the impact face (except for the designs or local variations in thickness) are substantially parallel.

Various preferred embodiments according to the present invention are described below, which can of course be combined with each other as appropriate:

said body has an apparent density of less than 8 $g/cm^3$, the grains of the material constituting said body have a mean equivalent diameter of less than 500 micrometers and a Vickers hardness greater than 3 GPa, preferably greater than 10 Gpa.

the material constituting said body comprises grains of metallic material and/or ceramic and/or cermet.

said grains have a maximum equivalent diameter of less than or equal to 500 micrometers, preferably less than or equal to 400 micrometers or even less than or equal to 300 micrometers. Preferably, the maximum equivalent diameter of said grains is greater than 5 micrometers, preferably greater than 10 micrometers or even greater than 50 micrometers.

Said ceramic and/or cermet grains are preferably bonded by a matrix, said matrix comprising or consisting of a silicon nitride phase and/or a silicon oxynitride phase, said matrix representing between 5 and 40% by weight, preferably between 15 and 35% by weight, of said material constituting the ceramic body.

Said grains are made of a carbide or a metal boride. More preferably, it is silicon carbide or boron carbide grains or a mixture of these two carbides. According to one possible mode, the material constituting said body comprises only silicon carbide grains, with possibly a metallic phase, preferably comprising the element silicon.

said body, preferably ceramic, has an apparent density of less than 5 $g/cm^3$, preferably less than 3.2 $g/cm^3$, preferably an apparent density of less than 3.0 $g/cm^3$.

Preferably, the constituent grains of the material constituting said body consist essentially of SiC, preferably in alpha form.

said material constituting said body has an open porosity higher than 5%, preferably higher than 6%, more preferably higher than 7% or even higher than 8%, and lower than 14%, preferably lower than 13%, more preferably lower than 12%.

said body has a mass to surface area ratio or surface density, measured in $kg/m^2$, greater than 60 and/or preferably less than 200.

Said body may be a plate, a tube or any other shape making it possible to produce a breastplate, a shield, a vehicle bodywork component, a radar dome, a helmet, from which the screening element according to the invention may be selected.

The invention also relates to an antiballistic protection device comprising the screening element according to the invention, wherein:

said body is provided on its inner face or the face opposite to the impact face with an energy-dissipating back coating, made of a material of lower hardness than that of the material constituting said body, wherein the material constituting the back coating is selected from polyethylenes PE, in particular ultra high density polyethylenes (UHMPE), glass or carbon fibers, aramids, metals such as aluminum, titanium or their alloys or steel.

the ceramic body-back coating assembly is surrounded by a shell of a containment material.

the containment material constituting the shell is selected from glass or carbon fibers or aramids.

FIGURES

FIG. 1 describes the geometric parameters and possible shape of a screening body according to the invention.

FIGS. 2*a*, 2*b*, 2*c*, 2 *g*, 2*h*, 2*i* and 2*j* show a cross-sectional view of the screening bodies provided for comparison. FIGS. 2*d*, 2*e* and 2*f* relate to profiled screening bodies according to the invention.

FIG. 3 shows the evolution of the surface area $A_i/A_0$ as a function of the thickness $E_i/E_m$ for different example embodiments. A thickness of zero (0) corresponds to the surface plane $A_0$ of the lower face and a thickness of 100 corresponds to the plane with the maximum thickness $E_m$.

FIG. 4 illustrates a screening body with a portion of the impact surface having joined designs.

FIG. 5 shows a screening body with a portion of the impact surface with regularly spaced designs.

FIG. 6 shows a screening body with a portion of the impact surface with two different alternate designs.

FIG. 7 shows a screening body whose impact surface comprises a circular distribution of designs.

FIG. 8 shows a screening body whose impact surface comprises sinusoidal profile designs.

FIG. 9 shows a screening body whose impact surface comprises alternate joined designs.

FIG. 10 shows an impact surface of two screening elements according to the invention comprising a complex design consisting of sub-designs, of sinusoidal type with harmonics.

FIG. 11 shows an impact surface of two screening elements according to the invention comprising a complex design of pyramid-like sub-designs with regular steps.

FIG. 12 shows a 3-dimensional view of a screening body according to example 8.

FIG. 13 shows a 3-dimensional view of a screening body according to example 9.

FIG. 14 shows a 3-dimensional view of a screening body according to example 10.

FIG. 1 schematically shows in cross-section an example of a screening body 10 according to the invention, in the form of a monolithic body having an outer face 20 (or impact face) and an inner face 30 (opposite said impact face). The body has a plate shape of mean thickness $E_m$ and total length 40. The mean thickness is determined as shown below and takes into account the texturing of the outer surface on the textured portion 50. According to the invention, the textured portion (50) represents at least 10%, preferably more than 20%, more than 30%, more than 40%, more than 50%, or even more than 75% or even 100% of the outer surface of the monolithic body of the screening element. On this portion 50, the outer face 20 is textured in such a way that the area Ai of a plane i of internal section with intermediate thickness $E_i$, decreases starting from the inner face 30 of area $A_0$ from a value of i greater than at least 50, i corresponding in percentage to the fraction of said mean thickness $E_m$ at plane i. The area $A_{100}$ corresponds to the area of material at the mean thickness $E_m$. As shown in FIG. 1, $E_{sm}$ is the thickness $E_i$ from which the area Ai decreases.

On the portion 50 of its impact face, the body has a plurality of designs corresponding to a local variation in the thickness of said body. A design 60 has a height $h_1$, a width $\phi_1$ and a center $C_1$. Spacing $D_{1-2}$ between design 60 of center $C_1$ and the one adjacent to center $C_2$ is also shown.

DEFINITIONS

The following indications and definitions are given in connection with the preceding description of the present invention:

The mean thickness $E_m$ of said body refers to the mean thickness over the portion of the body comprising the texturing.

It is calculated by dividing:

- the different thicknesses measured at the location of each design or protrusion, perpendicularly to the inner face if it is flat or perpendicularly to the tangent of said inner face at the point considered, if this face is curved,
- by the number of protrusions or designs identified on said portion.

Reference may be made to FIG. 1, which shows the positioning of the said mean thickness.

Surface portion means the minimum polygonal surface surrounding a family of designs, this surface being delimited by linear segments tangential to the peripheral designs. A family of designs consists for example of designs such that the distance between two immediately adjacent designs is less than five times the width or diameter of the widest design. Preferably, but not necessarily, a portion can group together designs of the same morphology and/or height or width.

The center of a design is the barycenter of the surface of said design projected perpendicularly on the plane corresponding to the inner face of the body. Typically in the case of right pyramids, the center is the top of the pyramid that becomes the center of the base by projection perpendicularly on the plane corresponding to the inner face.

A plate is a geometric shape in which the surface area of the largest face is at least 5 times, preferably 10 times, greater than its thickness.

The equivalent diameter of a grain is defined as half the sum of the greatest length of the grain and the greatest width of the grain, measured in a direction perpendicular to said greatest length.

Hard material means a material whose hardness is sufficiently high to justify its use in armor or screening elements.

The maximum and mean equivalent diameters are conventionally determined from the observation of the microstructure of the material constituting the ceramic body, conventionally by virtue of images taken in SEM (scanning electron microscopy) on a cross section of the sintered product. It has been verified in the following examples that said microstructure is substantially identical, regardless of the orientation of the cross section.

The "apparent density" of a product, within the meaning of the present invention, means the ratio equal to the mass of the product divided by the volume occupied by said product. It is conventionally determined by the Archimedes method. For example, the ISO 5017 standard specifies the conditions for such a measurement. This standard also makes it possible to measure the open porosity within the meaning of the present invention.

Cermet refers to a composite material composed of a ceramic reinforcement and a metal matrix.

"Matrix" refers to a crystallized or non-crystallized phase that provides a substantially continuous structure between the grains. It is obtained, during the preparation of the material, typically during its firing, from the constituents of the starting charge and possibly from the constituents of the gaseous environment of this starting charge and/or from a molten metal infiltrating the porosity of said material during or after its firing. A matrix substantially surrounds the grains of the granular fraction, i.e. coats them.

Sintering of a material is a process for manufacturing parts such as the screening element according to the invention consisting of heating a mixture comprising a powder without bringing it to melting. Under the effect of heat, the grains weld together, which forms the cohesion of the part.

In a ceramic body according to the invention, the ceramic grains are bound by the matrix. During the firing or sintering process, they substantially retain the same shape and chemical nature as in the starting charge. In the sintered ceramic body, the matrix and the grains together represent 100% of the mass of the product. In the case of ceramic bodies with a nitride matrix, one or more metals are preferably added to the charge, which react with the nitrogenous atmosphere to form one or more nitrogenous crystallized phases. The resulting increase in volume, typically from 1 to 30%, advantageously makes it possible to fill the pores of the matrix and/or to compensate for the shrinkage caused by the sintering of the grains. This reactive sintering thus makes it possible to improve the mechanical strength of the sintered product. The reactively sintered products thus exhibit closed porosity that is significantly lower than other sintered products under similar temperature and pressure conditions. During the firing process, the reactively sintered products essentially exhibit no shrinkage.

The crystallographic composition of the material constituting the monolithic body is normally obtained by X-ray diffraction and Rietveld analysis.

The crystallized phases, especially the nitrogenous crystallized phases, were measured by X-ray diffraction and quantified by the Rietveld method.

Elemental nitrogen (N) levels in sintered products were measured using LECO analyzers (LECO TC 436DR; LECO CS 300). Values are provided in mass percentages.

The residual silicon in metallicform in the sintered material or afterfiring is normally measured according to the method known to skilled persons and referenced underANSI B74-151992 (R2000).

The Vickers hardness of grains can be measured with a standardized diamond pyramid tip with a square base and an apex angle between faces equal to 136°. The imprint made on the grain therefore has the shape of a square; the two diagonals d1 and d2 of this square are measured with an optical device. The hardness is calculated from the force applied to the diamond tip and the mean d value of $d_1$ and $d_2$ according to the following formula:

$$H_V = 0.189 \cdot \frac{F}{d^2} \quad \text{with} \quad \begin{array}{l} H_V = \text{Vickers hardness} \\ F = \text{Applied force } [N] \\ d = \text{Mean of diagonals of the imprint [mm]} \end{array}$$

The strength and duration of the application are also standardized. The reference standard for ceramic or cermet materials is ASTM C1327:03 Standard Test Method for VICKERS Indentation Hardness of Advanced Ceramics. For a sintered metal material, the reference standard is ISO6507-1.

Unless otherwise specified, all percentages in this description are mass percentages.

The screening element according to the invention enables protection in particular against any type of projectile, for example a bullet, a shell, a mine or an element projected during the detonation of explosives, such as splinters, bolts, nails (or IED for "Improvised Explosive Device"), but also with respect to bladed weapons and normally constitutes an armor element for vehicles, generally in the form of modules such as plates.

According to the invention, it conventionally comprises at least two layers: a first ceramic part as described previously associated with another less hard and preferably ductile material, on the rear face, conventionally called "backing", such as polyethylene fibers (e.g.: Tensylon™, Dyneema®, Spectra™), aramid (e.g.: Twaron™, Kevlar®), glass fibers, or metals such as steel or aluminum alloys, in the form of plates. Adhesives, for example based on polyurethane or epoxy polymers, are used to bind the various elements constituting the screening element.

Under the impact of the projectiles, the material of the monolithic body fragments and has the main role of breaking down the perforating power of the projectiles. The role of the rear face, associated with the material constituting said body, is to consume the kinetic energy of the debris and to maintain a certain level of containment of said body further optimized by the containment shell.

The following examples are for illustrative purposes only and do not limit the scope of the present invention in any of the aspects described.

EXAMPLES

In all the following examples, ceramic plates of different sizes were made by casting a suspension in a plaster mold according to the process described above and the formulation described in Table 1 below.

The mean and maximum equivalent grain diameters were determined from the observation of the microstructure of the material constituting the ceramic body, conventionally by virtue of images taken by scanning electron microscopy on a cross section of the sintered product.

TABLE 1

| Composition of the initial mixture (% by mass) | |
|---|---|
| SiC powder 10-150 μm $D_{50}$ = 75 μm | 39.5 |
| SiC powder 0.1-5 μm $D_{50}$ = 2.5 μm | 37.5 |
| Si powder 0.5-50 μm $D_{50}$ = 20 μm | 17 |
| Alumina powder $D_{50}$ = 2.5 μm | 5.0 |
| $Fe_2O_3$ 2.5 μm | 0.5 |
| $B_4C$ 95% <45 μm $D_{50}$ = 18 μm | 0.5 |
| total minerals % | 100 |
| water added % | +12.5 |
| added dispersant % | +0.5 |
| **Forming and firing conditions** | |
| Casting plaster mold demolding after hardening | |
| Drying (T °/duration) | 110° C./24 h |
| Firing (T °/duration/time) | 1420° C./8 h/Nitrogen |
| Mean equivalent diameter of SiC grains in the material after firing (micrometers) | 80 |
| Maximum equivalent diameter of SiC grains in the material after firing (mm) | 0.2 |

Different shapes were made from molds whose geometric surface was modified in order to vary the profile of said surface. For each configuration, the thickness was adjusted in order to obtain a constant surface density of material for all the examples. The different profiles are shown in FIG. 2. The profile in example 1 corresponds to a flat plate without designs. The profiles of examples 2 to 7 have a sinusoidal profile whose height h varies according to the function a×cos(b×x), x being the abscissa in an axis of the section plane parallel to the rear face, x varying from 0 to π/b. For each implementation, the geometrical characteristics of the plates thus realized are gathered together in Table 2.

For each example, three assemblies were made by bonding the side of the ceramic plate opposite to the impact to a polycarbonate plate using 3M 950™ double-sided tape from the company 3M.

Each assembly was then placed in front of thirty 10 mm thick polycarbonate sheets. The whole was fired at from a distance of 15 meters with a 7.62×51 mm P80 caliber at a velocity of 820 m/s. Ballistic performance was assessed by measuring the depth of penetration of the bullet in the polycarbonate plates. An index was calculated based on a reference plate set at 100. The higher the index, the higher the depth proportionally and the lower the ballistic performance.

The surface density $\rho_a$ is calculated according to the following formula $\rho_a = t \times \rho_v$ where:

$\rho_a$ is the surface density expressed in Kg/m$^2$ t is the thickness of the plate, expressed in m $\rho_v$ is the apparent density expressed in Kg/m$^3$ typically measured according to ISO 18754.

The results reported in Table 2 below show the advantages of using a monolithic screening plate according to the invention.

In Table 2 below:

$A_0$ is the area occupied by the material on the inner surface of the plate.

$E_m$ (in mm) is the mean thickness of the body, according to the meaning previously described.

$E_{sm}$ (in mm) is the thickness $E_i$ from which the area Ai decreases, i.e. the thickness from which the texturing appears in the plate, measured from the inner face of the plate (see FIG. 1).

$A_{75}$ (in mm$^2$) is the area occupied by the material alone (i.e. excluding the unfilled areas between each design), according to a sectional plane parallel to the inner face of the plate and located at a distance from said inner face equal to 75% of the thickness $E_m$.

$A_{95}$ (mm$^2$) is the area occupied by the material alone (i.e. excluding the unfilled areas between each design), according to a sectional plane parallel to the inner face of the plate and located at a distance from said inner face equal to 95% of the thickness $E_m$.

$A_{100}$ (mm$^2$) is the area occupied by the material alone (i.e. excluding the unfilled areas between each design), according to a sectional plane parallel to the inner face of the plate and located at a distance from said inner face equal to the thickness $E_m$.

The ratio $E_{sm}/E_m$ corresponds to the value of i at which the surface of an intermediate area $A_i$ is less than the area $A_0$.

TABLE 2

| | Ex.1** | Ex.2** | Ex.3** | Ex.4* | Ex.5* | Ex.6* | Ex.7** | Ex8* | Ex9** | Ex10** |
|---|---|---|---|---|---|---|---|---|---|---|
| FIG. | 2a | 2b | 2c | 2d | 2e | 2f | 2g | 2h | 2i | 2j |
| $A_0$ (cm$^2$) | 100 | 100 | 100 | 100 | 100 | 100 | 100 | 100 | 100 | 100 |
| $E_m$ (mm) | 7 | 11.4 | 10.5 | 9.9 | 8.5 | 9.9 | 7.1 | 10 | 6.6 | 8.5 |
| $E_{sm}$ (mm) | NA | 5.4 | 6.5 | 5.9 | 6.5 | 5.9 | 6.9 | 5.9 | 5.3 | 6.5 |
| $E_{sm}/E_m$ (%) | NA | 47 | 62 | 60 | 70 | 60 | 97 | 59 | 82 | 76 |
| $A_{50}$ (cm$^2$) | 100 | 65 | 100 | 100 | 100 | 100 | 100 | 100 | 100 | 100 |
| $A_{75}$ (cm$^2$) | 100 | 21.2 | 14.7 | 30.7 | 100 | 30.3 | 100 | 29.2 | 100 | 100 |
| $A_{80}$ (cm$^2$) | 100 | 15 | 10 | 20 | 50.2 | 22.5 | 100 | 21.1 | 100 | 50.2 |
| $A_{85}$ (cm$^2$) | 100 | 10.1 | 5.1 | 15.5 | 31.3 | 15.9 | 100 | 14.0 | 88.7 | 32.2 |
| $A_{90}$ (cm$^2$) | 100 | 5.9 | 2.5 | 10 | 18.5 | 10.0 | 100 | 7.8 | 80.7 | 16.1 |
| $A_{95}$ (cm$^2$) | NA | 2.9 | 0.3 | 4.5 | 8.4 | 4 | 100 | 2.8 | 51.4 | 11.1 |
| $A_{100}$ (cm$^2$) | NA | 0 | 0 | 0 | 0 | 0 | 0 | 0 | 0 | 10.5 |
| design profile a b | NA | a = 3 b = 0.4 | a = 1 b = 0.4 | a = 2 b = 0.2 | a = 1 b = 0.4 | a = 2 b = 0.4 | a = 0.12 b = 0.4 | NA | NA | NA |
| Height h of the designs (mm) | 0 | 6 | 4 | 4 | 2 | 4 | 0.25 | 4.1 | 1.25 | 2.03 |
| Diameter Φ of the designs (mm) | NA | 15.2 | 15.2 | 30.5 | 15.2 | 15.2 | 15.2 | 30.5 | 15.2 | 15.2 |
| Spacing D between designs (mm) | NA | 15.2 | 22.9 | 30.5 | 15.2 | 15.2 | 15.2 | 30.5 | 15.2 | 15.2 |
| $\rho_a$ (Kg/m$^2$) | 19.6 | 19.6 | 19.6 | 19.6 | 19.6 | 19.6 | 19.6 | 18.7 | 20.1 | 19.7 |
| Ballistic results | 100 | 130 | 84 | 43 | 72 | 49 | 98 | 85 | 95 | 90 |

*according to the invention

**comparative

"NA" = not applicable

The change in surface area $A_i/A_0$ as a function of the thickness $E_i/E_m$ for different example embodiments is shown in FIG. 3.

Examples 4, 5 and 6 according to the invention have a significantly improved ballistic performance compared to the comparative examples, especially example 1 (flat plate without a design). The comparison of examples 2 and 7 (outside the invention) with examples 5 and 6 (according to the invention) shows that the selection of the height, width and spacing of equal designs so as to obtain a profile such that $E_{sm}$ is between $0.5 \times E_m$ and $0.95 \times E_m$ improves ballistic performance.

The comparison of example 3 (outside the invention) with example 4 (according to the invention) shows in particular that despite the increased spacing of wider designs, the choice of a profile adapted according to the invention with a corresponding surface area $A_{95}$ of the screening element greater than 3% of the inner surface area $A_0$ ($A_{95} > 0.03\ A_0$) makes it possible to increase performance very significantly.

Of course, the present invention is not limited to the embodiments described and shown, provided by way of examples. In particular, combinations of the various embodiments described are also within the scope of the invention.

Example 8, representative of the publication US2015253114A1, shows a profile with cone-shaped tips whose surface area $A_{95}$ is less than 3% of $A_0$. It appears from the results reported in the preceding Table 2 that this profile is less efficient than that of example 4 with a surface area $A_{95}$ greater than 3% of $A_0$.

The comparative example 9 shows, on the contrary, that a less "pointed" profile, i.e. such that the surface area $A_{95}$ is greater than 50% of $A_0$, leads to a lower ballistic performance than examples 5 and 6 with equivalent surface density of designs.

The comparative example 10, whose impact surface is formed by truncated pyramids, shows that a surface area $A_{100}$ greater than 10% of $A_0$ leads to a lower ballistic performance, in contrast to example 5 according to the invention.

The invention claimed is:

1. A screening element, in the form of a monolithic body having an outer face or impact face and an inner face, opposite said impact face wherein:

said body is made of a sintered material, surfaces of said inner and outer faces are greater than or equal to 100 $cm^2$, wherein at least a portion of said impact face of said body is textured, such that, a mean thickness $E_m$ between said outer and inner faces of said body on said portion is greater than 4 mm, on said portion and along a plane i of internal section of said body parallel to said inner face, with $0<i<100$ and i corresponding, in percentage, to a fraction of said mean thickness $E_m$ at plane i, starting from the inner face of area $A_0$ and in a direction of the impact face of area $A_{100}$, Ai being the area occupied by the material alone according to said plane i:

a thickness $E_i$ from which the area Ai decreases is greater than 50% and less than 80% of the mean thickness $E_m$, and $A_i$ decreases along i, when $A_i<A_0$, and $A_{75}\geq 0.2\times A_0$, and $0.03\times A_0<A_{95}<0.5\times A_0$ and $A_{100}<0.1\times A_0$, on said portion, the impact face has a plurality of joined designs corresponding to a local variation in thickness of said monolithic body, said local variation in thickness follows a function or profile whose curve in a plane perpendicular to the plane i has a plurality of changes in curvature, and a height h of each of the plurality of designs is between 0.05 and 0.5 times the mean thickness $E_m$.

2. The screening element according to claim 1, wherein said inner and outer faces are parallel to each other.

3. The screening element according to claim 1, wherein $A_{85}<0.8\times A_0$.

4. The screening element according to claim 1, wherein from a value of i greater than at least 50, a relative change $(A_{i+2}-A_i)\times 100/A_i$ is less than 30%.

5. The screening element according to claim 1, wherein from a value of i greater than at least 75, the relative change $(A_{i+2}-A_i)\times 100/A_i$ is less than 20%.

6. The screening element according to claim 1, wherein the thickness $E_i$ from which the area $A_i$ decreases is greater than 55% and/or less than 75% of the mean thickness $E_m$ of said body.

7. The screening element according to claim 1, wherein a width or diameter ϕof the designs of said portion is between 1 and 5 times the thickness $E_m$.

8. The screening element according to claim 1, wherein the width or diameter ϕof the designs of said portion, is greater than or equal to 3 mm and/or less than or equal to 40 mm.

9. The screening element according to claim 1, wherein the height h of the designs, of said portion is greater than or equal to 0.5 mm and/or less than or equal to 5 mm.

10. The screening element according to claim 1, wherein said design extends by translation along one direction.

11. The screening element according to claim 1, wherein said design is composed of superimposed sub-designs, the sub-designs being of the same basic shape according to a different scale.

12. The screening element according to claim 1, wherein the sintered material constituting said body has an apparent density of less than 8 $g/cm^3$ and/or and a Vickers hardness of greater than 3 GPa.

13. The screening element according to claim 1, wherein the sintered material constituting said body comprises grains of metallic and/or ceramic and/or cermet material.

14. The screening element according to claim 13, wherein the grains have a mean equivalent diameter of less than 500 micrometers.

15. The screening element according to claim 13, wherein said grains are constituted of a carbide or boride.

16. The screening element according to claim 1, wherein said body has a mass to surface area ratio or surface density, measured in $kg/m^2$, greater than 60 and/or less than 200.

17. The screening element according to claim 1, wherein the shape of said body is selected from a plate, a tube or another shape for making a breastplate, a shield, a chassis of a vehicle, a radar dome, a helmet.

18. The screening element according to claim 1, wherein the function or profile is sinusoidal.

19. The screening element according to claim 18, wherein the height h of the designs varies according to a function a*cos(b*x), x being the abscissa in an axis of the section plane parallel to a rear face of the monolithic body, x varying from 0 to π/b.

20. The screening element according to claim 1, wherein the monolithic body is a ceramic body that comprises an energy-dissipating back coating surrounded by a shell of a containment material.

* * * * *